US009567953B2

(12) United States Patent
Oohashi

(10) Patent No.: US 9,567,953 B2
(45) Date of Patent: Feb. 14, 2017

(54) FUEL PUMP MODULE

(71) Applicant: DENSO CORPORATION, Kariya, Aichi-pref. (JP)

(72) Inventor: Masaharu Oohashi, Takahama (JP)

(73) Assignee: DENSO CORPORATION, Kariya (JP)

( * ) Notice: Subject to any disclaimer, the term of this patent is extended or adjusted under 35 U.S.C. 154(b) by 209 days.

(21) Appl. No.: 14/470,090

(22) Filed: Aug. 27, 2014

(65) Prior Publication Data

US 2015/0059708 A1 Mar. 5, 2015

(30) Foreign Application Priority Data

Aug. 28, 2013 (JP) ..... 2013-176936

(51) Int. Cl.

| | |
|---|---|
| ***F02M 37/04*** | (2006.01) |
| ***F02M 37/00*** | (2006.01) |
| ***F02M 37/02*** | (2006.01) |
| ***F02M 37/10*** | (2006.01) |
| ***F02M 37/18*** | (2006.01) |

(52) U.S. Cl.

CPC ..... *F02M 37/0088* (2013.01); *F02M 37/025* (2013.01); *F02M 37/106* (2013.01); *F02M 37/18* (2013.01)

(58) Field of Classification Search

CPC .... F02M 39/20; F02M 37/0088; F02M 37/22; F02M 37/0047; F02M 37/04; F02M 37/10; F02M 37/18

USPC ..... 123/495, 509

See application file for complete search history.

(56) References Cited

U.S. PATENT DOCUMENTS 5,275,200 A * 1/1994 Yamamoto ..... F16K 5/0647 137/315.18
6,840,143 B1 * 1/2005 Lin ..... B25B 23/0035 81/177.85

(Continued)

FOREIGN PATENT DOCUMENTS

JP 2000-045900 2/2000
JP 2001-280210 10/2001

(Continued)

OTHER PUBLICATIONS

U.S. Appl. No. 14/470,198, filed Aug. 27, 2014 in the name of Masaharu Oohashi.

(Continued)

*Primary Examiner* — Lindsay Low
*Assistant Examiner* — Syed O Hasan
(74) *Attorney, Agent, or Firm* — Nixon & Vanderhye P.C.

(57) ABSTRACT

A noise from a fuel pump module is reduced by housing a port injection (PI) fuel pump in a pump case of a fuel tank, in a structure in which the PI fuel pump is held with a bracket that is provided at a position between the PI fuel pump and a PI suction filter. The PI fuel pump and the bracket that engages with the pump case are interposed by an elastic member that abuts a base part of the bracket. In operation, when the PI fuel pump transmits its vibration to the pump case through the elastic member and the bracket, the elastic member dampens and reduces the vibration transmitted to the bracket, thereby reducing the noise by a reduction of transmitted vibration through the pump case to a subtank and the fuel tank.

10 Claims, 8 Drawing Sheets

(56) References Cited

U.S. PATENT DOCUMENTS

| | | | | |
|---|---|---|---|---|
| 2005/0241617 | A1* | 11/2005 | Kojima | F02D 41/3094 123/446 |
| 2006/0065249 | A1* | 3/2006 | Powell | F02M 37/0017 123/510 |
| 2008/0184971 | A1* | 8/2008 | Lubinski | F02M 37/0058 123/511 |
| 2008/0216801 | A1 | 9/2008 | Kanamaru et al. | |

FOREIGN PATENT DOCUMENTS

| | | |
|---|---|---|
| JP | 2002-256993 | 9/2002 |
| JP | 2004-324611 | 11/2004 |
| JP | 2006-125248 | 5/2006 |
| JP | 2009-228653 | 10/2009 |
| JP | 2009-243330 | 10/2009 |

OTHER PUBLICATIONS

U.S. Appl. No. 14/470,004, filed Aug. 27, 2014 in the name of Masaharu Oohashi.
U.S. Appl. No. 14/469,930, filed Aug. 27, 2014 in the name of Masaharu Oohashi.
U.S. Appl. No. 14/469,965, filed Aug. 27, 2014 in the name of Masaharu Oohashi.
Office Action (2 pages) dated Jul. 9, 2015, issued in corresponding Japanese Application No. 2013-176936 and English translation (4 pages).

* cited by examiner

FUEL PUMP MODULE

CROSS REFERENCE TO RELATED APPLICATION

The present application is based on and claims the benefit of priority of Japanese Patent Application No. 2013-176936, filed on Aug. 28, 2013, the disclosure of which is incorporated herein by reference.

TECHNICAL FIELD

The present disclosure generally relates to a fuel pump module.

BACKGROUND INFORMATION

Conventionally, a fuel pump module may utilize a plurality of fuel pumps having respectively different discharge pressures according to an engine operation state, for achieving a high output of the engine and/or for an improvement of the fuel mileage. That is, for example, a patent document 1 (i.e., Japanese Patent No.: JP-A-2009-228653) discloses a fuel pump module that includes a main pump, a sub-pump, a subtank, and a cover member. The subtank houses the main pump and the like in a cylindrical shape body with a bottom. The cover member closes an opening of the sub tank and supports the main pump and the like.

However, in the fuel pump module of the patent document 1, vibration from the two pumps during operation is transmitted to the cover member which supports the two pumps. Such a vibration may be further amplified when it is conveyed to the fuel tank through the cover member and the sub tank.

It is an object of the present disclosure to provide a fuel pump module that reduces noise.

In an aspect of the present disclosure, a fuel pump module that supplies fuel from a fuel tank to an internal-combustion engine. The fuel pump module includes a first suction filter removing foreign substance from fuel in the fuel tank, a first pump discharging fuel that has passed through the first suction filter into a combustion chamber of the internal-combustion engine, a first filter removing foreign substance from fuel that is discharged from the first pump, and a first supply port disposed at a position between the first filter and the combustion chamber and allowing fuel that has passed through the first filter to flow therethrough. The fuel pump module also includes a second suction filter removing foreign substance from fuel in the fuel tank separately from the first suction filter, a second pump discharging fuel that has passed through the second suction filter into an air-intake system of the internal-combustion engine, a second filter removing foreign substance from fuel that is discharged from the second pump, a second supply port disposed at a position between the second filter and the air-intake system and allowing fuel that has passed through the second filter to flow therethrough. Further, the fuel pump module includes a housing member housing one of the first pump and the second pump, a support part formed on the housing member and supporting an other of the first pump and the second pump, a regulating member engaging the housing member at a position between (i) the first suction filter and the first pump or (ii) the second suction filter and the second pump, the regulating member regulating a relative movement of the first pump or the second pump toward a center axis thereof relative to the housing member, and an elastic member made of an elastic material, abutting the regulating member and interposed between (i) the first pump and the regulating member or (ii) the second pump and the regulating member.

In the fuel pump module of the present disclosure, two pumps, two filters, and two supply ports are provided, and a housing member housing one of the two pumps has the support part that supports the other one of the two pumps. Movement of the one of the two pumps housed in the housing member is regulated by the regulating member that engages with the housing member, i.e., the movement of the one of the two pumps toward the center axis of the relevant pump relative to the housing member. In such a structure, vibration caused by an operation of the pump is transmitted to the fuel tank through the housing member and the regulating member. An elastic member in between the pump in the housing member and the regulating member reduces the transmission of vibration from the pump in the housing member to the regulating member, thereby reducing the transmission of the vibration to the housing member. As a result, the noise generated by the vibration is reduced due to the reduction of the transmitted vibration that is transmitted from the housing member to the fuel tank.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Hereafter, the embodiment of the present disclosure is described based on the drawings.

(One Embodiment)

Figure 1:
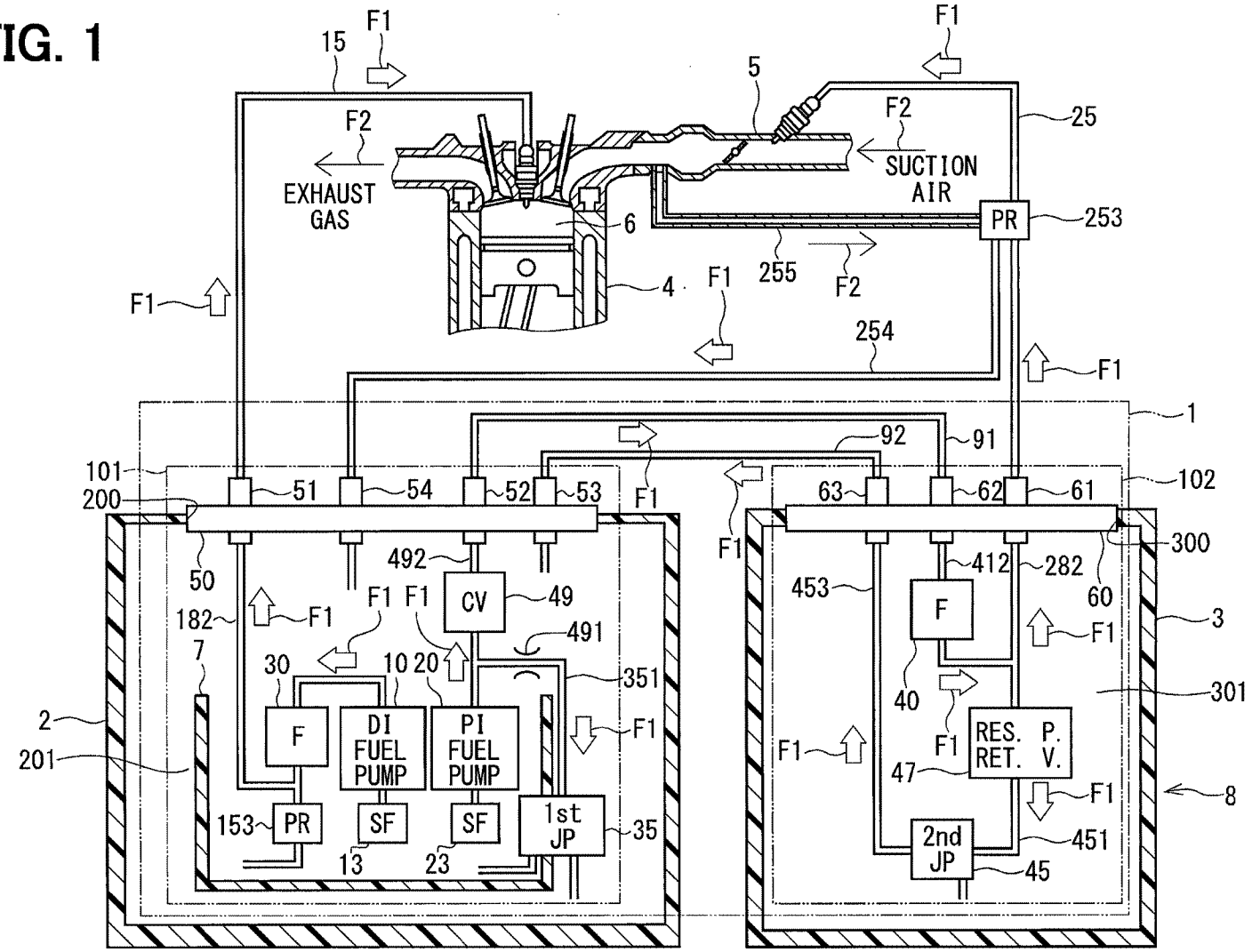
FIG. 1 is a block diagram of a system of a fuel pump module in one embodiment of the present disclosure.

The block diagram explaining a system of a fuel pump module 1 in one embodiment of the present disclosure is shown in FIG. 1. The fuel pump module 1 supplies, to an engine 4, a fuel stored by a fuel tank 8 which has two "fuel reservoir rooms", i.e., a first tank room 201 and a second tank room 301. The fuel pump module 1 supplies, to either one of a combustion chamber 6 of the engine 4 or an air-intake system 5 which is connected to the engine 4, the fuel in different pressures according to a drive state of the engine 4. The fuel pump module 1 is, as shown in FIG. 1, comprised of a first module 101 and a second module 102 together with other parts such as transport pipes 91 and 92 etc. by which the first module 101 and the second module 102 are connected for flowing the fuel back and forth between a first tank 2 and a second tank 3. Further, a white arrow F1 in FIG. 1 shows a flow of the fuel. Further, a solid line arrow F2 in FIG. 1 shows a flow of a gas.

The first module 101 is disposed in the first tank 2. The first module 101 pressurizes the fuel in the first tank 2, and supplies the pressurized fuel to the engine 4, or transports it to the second tank 3. The first module 101 comprises a direct injection suction filter 13 (hereafter designated as a "DI suction filter 13"), a direct injection fuel pump 10 (i.e., hereafter designated as a "DI fuel pump 10"), a port injection suction filter 23 (i.e., hereafter designated as a "PI suction filter 23"), a port injection fuel pump 20 (i.e., hereafter designated as a "PI fuel pump 20"), a direct injection filter 30 (i.e., hereafter designated as a "DI filter 30"), a first jet pump 35, a first flange 50, a subtank 7, and other parts. The DI suction filter 13 is equivalent to a "first suction filter" in the claims. The DI fuel pump 10 is equivalent to a "first pump" in the claims. The PI suction filter 23 is equivalent to a "second suction filter" in claims. The PI fuel pump 20 is equivalent to a "second pump" in the claims. The DI filter 30 is equivalent to a "first filter" in the claims.

The DI suction filter 13 comprises a saccate element part 131, a cylindrical connection part 132, etc. The DI suction filter 13 removes foreign substance from the fuel in the subtank 7 by using the element part 131. The connection part 132 is disposed at a position between the saccate element part 131 and the suction part 12 of the DI fuel pump 10, and is connected to the suction part 12. The connection part 132 providing a connection port 133 allows a communication between an inside of the element part 131 and a suction port 121 of the suction part 12 of the DI fuel pump 10.

The DI fuel pump 10 is an electromotive pump disposed in the subtank 7 that is accommodated in the first tank 2. The DI fuel pump 10 pressurizes the fuel in the subtank 7 to 500 kPa, for example, and directly supplies the pressurized fuel to the combustion chamber 6 of the engine 4 via a direct injection supply pipe 15 (i.e., hereafter designated as a "DI supply pipe 15") leading to a direct injection supply port 51 (i.e., hereafter designated as a "DI supply port 51") that is disposed on the first flange 50. In the fuel pump module 1 in one embodiment, it is configured that an amount of the fuel supplied from the DI fuel pump 10 to the engine 4 is greater than an amount of the fuel supplied from the PI fuel pump 20 to the engine 4. The DI fuel pump 10 comprises the suction part 12, a pump part 14, a motor part 16, a discharge part 18, and the like. The DI supply port 51 is equivalent to a "first supply port" in the claims.

The suction part 12 is disposed on a filter side (i.e. closer to the DI suction filter 13) of the DI fuel pump 10, and is connected to the pump part 14 of the DI fuel pump 10. The suction part 12 has the suction port 121. The suction port 121 allows communication between an inside of the DI suction filter 13 and an inside of the pump part 14. The suction port 121 is disposed at an away-from-axis position (i.e., a position that is different from a position of an axis of the DI fuel pump 10), and sends the fuel in the subtank 7 via the DI suction filter 13 to the pump part 14.

The pump part 14 comprises an impeller which is not illustrated, a pump case 141 which forms a pump room, in which the impeller is rotatably accommodated, together with other parts. The pump room allows communication between the suction port 121 of the suction part 12 and a discharge port 181 of the discharge part 18. On one side of the pump case 141 close to the DI suction filter 13, a vapor vent port 142 is formed for venting an evaporated fuel in the pump part 14 to an inside of the sub tank 7 (see FIG. 5).

The motor part 16 is a brushless motor which comprises a stator, a rotor, a shaft, and the like, all of which are not illustrated. When an electric power is supplied to a not-illustrated winding which is wound on a cylindrical stator via a wire harness 161 (see FIG. 2) and a power supply terminal 162, a rotor positioned in an inside of the stator rotates together with the shaft. A rotation torque of the shaft is transmitted to the impeller of the pump part 14. In such manner, the impeller of the pump part 14 rotates, the fuel in the pump room is pressurized, and the pressurized fuel is sent to the discharge part 18.

The discharge part 18 is disposed on an opposite side of the suction part 12 relative to the pump part 14 and the motor part 16. The discharge part 18 has the discharge port 181 which allows communication between an inside of the pump part 14 and an inside of the pump case 11. The fuel pressurized by the pump part 14 is sent to a fuel passage 111 that is formed in an inside of the pump case 11 via the discharge port 181.

The pump case 11 is a cylindrical member having a bottom, which is made of resin. The pump case 11 comprises a bottom part 112, a side part 113, a connection part 119, and the like. The DI fuel pump 10 and the DI filter 30 are accommodated in an inside of the pump case 11.

The bottom part 112 is formed substantially in a disk shape from resin. A through hole 116 is disposed on the bottom part 112 substantially in parallel with an axis of the DI fuel pump 10. The through hole 116 accepts a connector to be electrically connected to the power supply terminal 162 of the motor part 16 inserted therein.

Figure 4:
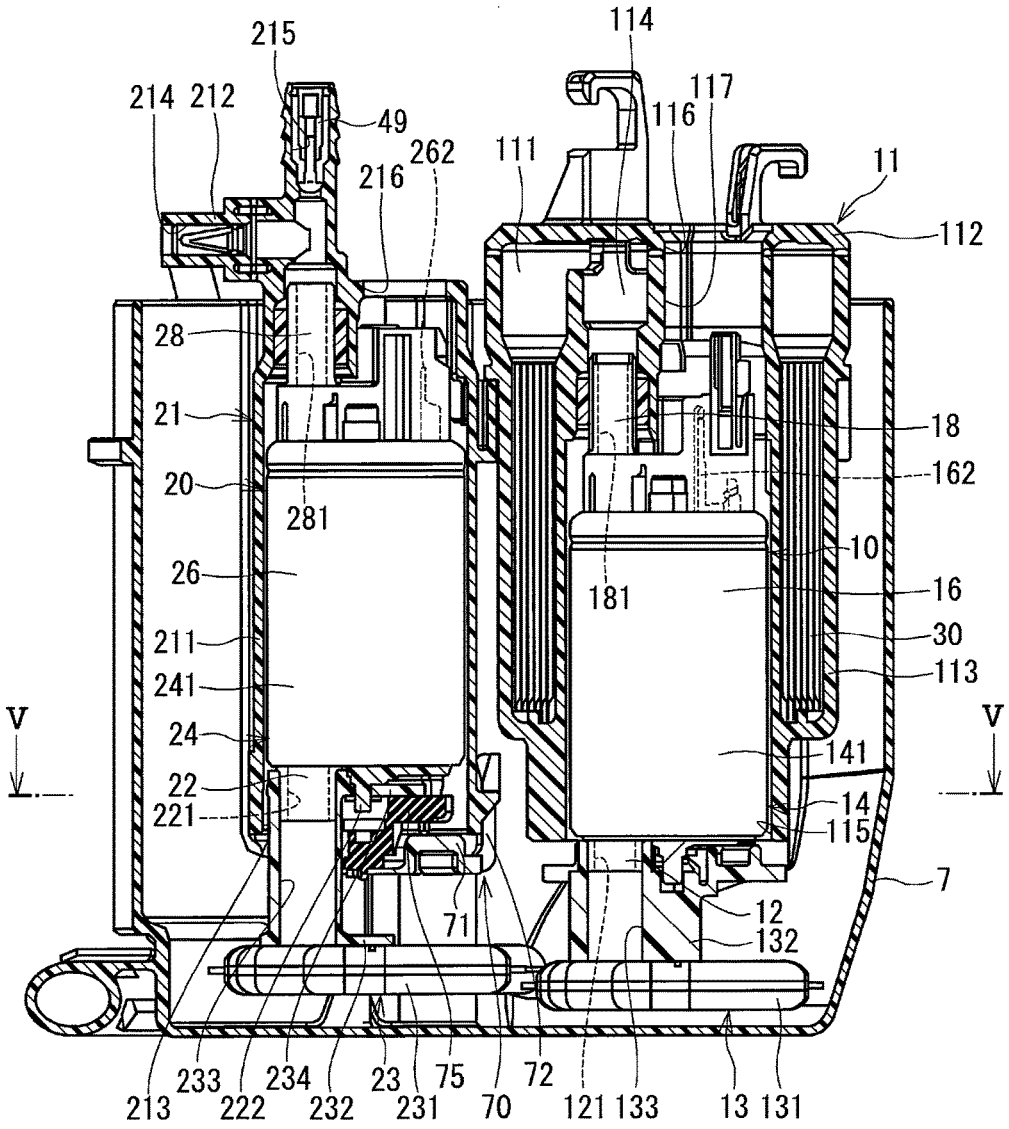
FIG. 4 is a sectional view of the first module in the fuel pump module along a IV-IV line in FIG. 3 in one embodiment of the present disclosure.

Referring to FIG. 4, the side part 113 has (i) a cylindrical space with a bottom, or a one-end-closed cylinder, with two openings, i.e., an opening 117 in communication with the through hole 116 of the bottom part 112 and an opening 115 that is formed on a filter side that is close to the DI suction filter 13, and (ii) a donut shape space, or a ring shape space, that is positioned on a radially-outer portion of the cylindrical space. In the one-end-closed cylinder, the DI fuel pump 10 is housed. The DI fuel pump 10 is housed in the one-end-closed cylinder through the opening 115. Further, through the opening 117, a connector that is electrically connected with the power supply terminal 162 is housed. At a position that corresponds to the discharge port 181 of the side part 113, a connection chamber 114 is formed for communication between the discharge port 181 and the fuel passage 111. The fuel discharged from the discharge port 181 flows through the connection chamber 114 and is sent into the fuel passage 111.

In the donut shape space of the side part 113, the DI filter 30 substantially in a cylindrical shape is housed. The DI filter 30 is made of a conductive resin which does not contain carbon, for example, and removes foreign substance from the fuel that is discharged from the discharge port 181. The fuel passing through the DI filter 30 is sent into the connection part 119 that is disposed on a radially-outer portion of the pump case 11.

The connection part 119 is disposed on a radially-outer portion of the side part 113, and houses a pressure regulating valve 153. The pressure of the fuel sent to the connection part 119 is adjusted to a desired value by the pressure regulating valve 153. The pressure adjusted fuel is then sent to an outside of the first tank 2 via a supply pipe 182 (see FIG. 1) and the DI supply port 51 that is disposed on the first flange 50.

The PI suction filter 23 includes a saccate element 231, a connection part 232 substantially in a cylindrical shape, and the like. The PI suction filter 23 removes foreign substance from the fuel in the subtank 7 by using the element 231. The connection part 232 is disposed at a position between the element 231 and a suction part 22 of the PI fuel pump 20, and is connected to the suction part 22. A connection port 233, which is provided by the connection part 232, allows communication between an inside of the element 23 and a suction port 221 which is a part of the suction part 22 of the PI fuel pump 20.

The PI fuel pump 20 is an electromotive pump disposed in the subtank 7 of the first tank 2 just like the DI fuel pump 10. The PI fuel pump 20 pressurizes the fuel in the subtank 7 to an arbitrary pressure level between 350 to 500 kPa, for example, and sends the fuel to the second tank 3 via a transport pipe 91 leading to a transport port 52 that is disposed on the first flange 50, and, at the same time, supplies the pressurized fuel to the first jet pump 35 that is mentioned later. The PI fuel pump 20 comprises the suction part 22, a pump part 24, a motor part 26, a discharge part 28, and the like.

The suction part 22 is disposed on a filter side of the PI fuel pump 20, close to the PI suction filter 23, of the PI fuel pump 20, and is connected to the pump part 24 of the PI fuel pump 20. The suction part 22 has the suction port 221. The suction port 221 allows communication between an inside of the PI suction filter 23 and an inside of the pump part 24. The suction port 221 is disposed at an away-from-axis position, i.e., a position that is different from a position of an axis of the PI fuel pump 20, and sends the fuel in the subtank 7 via the PI suction filter 23 to the pump part 24.

The pump part 24 comprises an impeller which is not illustrated, a pump case 241 which forms a pump room, in which the impeller is rotatably accommodated, together with other parts. The pump room allows communication between the suction port 221 of the suction part 22 and a discharge port 281 of the discharge part 28.

The motor part 26 is a brushless motor which includes a stator, a rotor, a shaft, and the like, all of which are not illustrated. When an electric power is supplied to a not-illustrated winding which is wound on a cylindrical stator via a wire harness 261 (see FIG. 2) and a power supply terminal 262, a rotor provided in an inside of the stator rotates together with the shaft. A rotation torque of the shaft is transmitted to the impeller of the pump part 24. In such manner, the impeller of the pump part 24 rotates, the fuel in the pump room is pressurized, and the pressurized fuel is sent to the discharge part 28.

The discharge part 28 is disposed on an opposite side of the suction part 22 relative to the pump part 24 and the motor part 26. The discharge part 28 has the discharge port 281 which allows communication between an inside of the pump part 24 and an inside of the pump case 21. The discharge part 28 is connected to a connection part 212 that is formed in an inside of the pump case 21. The fuel pressurized by the pump part 24 is sent to a connection part 212 through the discharge port 281.

The pump case 21 is a cylindrical member, which is substantially in a cylindrical shape made of resin. The pump case 21 comprises a cylinder part 211, a connection part 212, a support part 29 and the like. The pump case 21 is equivalent to a "housing member" in the claims.

The cylinder part 211 has a cylindrical shape having a bottom. On one side of the cylinder part 211 close to the suction filter 23, an opening 213 is formed. The PI fuel pump 20 is inserted into an inside of the pump case 21 through the opening 213. On the other side of the cylinder part 211, i.e., a far side relative to the suction filter 23, a through hole 216 is formed. The through hole 216 receives a connector inserted therein to be connected to a power supply terminal 262 of the motor part 26.

The connection part 212 disposed on the other side of the cylinder part 211, i.e., a far side relative to the suction filter 23. The connection part 212 has a flow passage that branches into two directions. One of the two branches, i.e., a flow passage 214, communicates with an inside of the first jet pump 35 via a supply pipe 351 (see FIG. 1 and FIG. 2) having an orifice 491. The other one of the two branches, i.e., a flow passage 215 houses a non-return valve 49 that regulates a flow of the fuel in one way. The fuel flowing in the other passage 215 is sent to an outside of the first tank 2 via a transport pipe 492 (see FIG. 1 and FIG. 2) and the transport port 52 disposed on the first flange 50.

Figure 3:
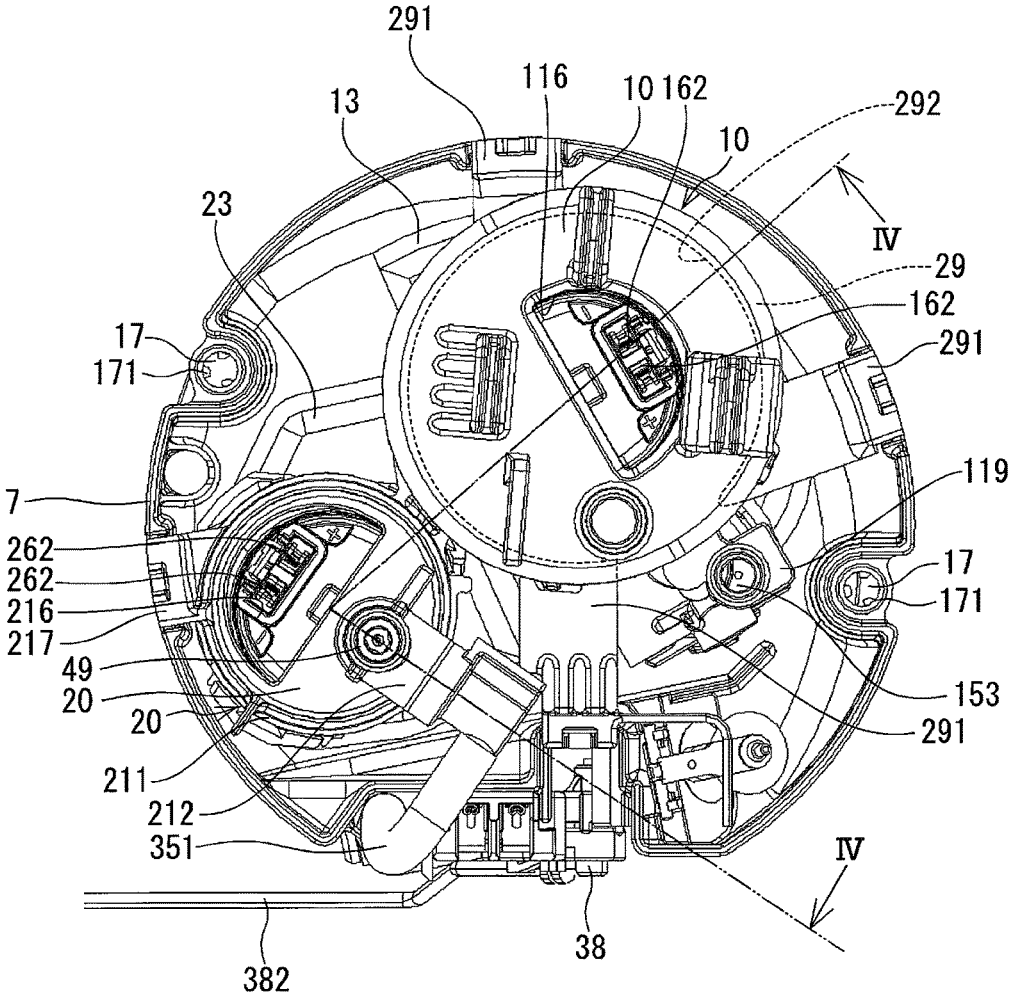
FIG. 3 is a top view of the first module in the fuel pump module in one embodiment of the present disclosure.

The support part 29 is formed to extend from an outer wall of the cylinder part 211. The support part 29 is, as shown in FIG. 3, formed to substantially have a C-shape in its cross section that is perpendicular to a center axis of the PI fuel pump 20. The support part 29 supports the pump case 11 by its insertion hole 292, into which the pump case 11 is inserted.

On a radially-outer portion of the support part 29, three stays 291 are provided, which respectively extend toward a radially-outer portion of the first sub-assembly 118, as shown in FIG. 3. Further, on an opposite side of the cylinder part 211 relative to the support part 29, a stay 217 is formed. The stays 217 and 291 are connected with the subtank 7 as shown in FIG. 3. Thereby, a relative position of each of the PI fuel pump 20, the DI fuel pump 10 and the DI filter 30 is fixed relative to the subtank 7, in which the PI fuel pump 20 is in a housed state in the pump case 21 and the DI fuel pump 10 and the DI filter 30 are in a supported state by the support part 29.

As shown in FIG. 4, a bracket 70 is provided at a position between the PI fuel pump 20 and the PI suction filter 23. The bracket 70 may be a member made of resin. The bracket 70 as a "regulating member" comprises a base part 71, an edge part 72, etc. The bracket 70 regulates a movement of the PI fuel pump 20 relative to the pump case 21. The PI fuel pump 20 revolves around a center axis of the pump 20.

The base part 71 is a plane board part that is provided substantially perpendicular to the center axis of the PI fuel pump 20. The base part 71 is formed in a fan shape with a center angle of greater than 180 degrees.

The edge part 72 is formed to extend from an edge of the base part 71, in an opposite direction opposite to the PI suction filter 23. In one embodiment of the fuel pump module 1, three edge parts 72 are provided. An inner wall of the edge part 72 is formed to be abuttable on an outer wall 219 of the cylinder part 211 of the pump case 21.

An elastic member 75 is formed with an elastic material, and is provided at a position between the bracket 70 and the PI fuel pump 20. Specifically, the elastic member 75 is formed to abut both of the base part 71 of the bracket 70 and a guide part 234 that is provided on a connection part 232 of the PI suction filter 23. The guide part 234 abuts the suction part 22 of the PI fuel pump 20, and guides a projected part 222 that is formed on the suction part 22 to project toward the PI suction filter 23 therefrom. The guide part 234 regulates a movement of the PI fuel pump 20 along a radius direction relative to the pump case 21 by the bracket 70.

Figure 5:
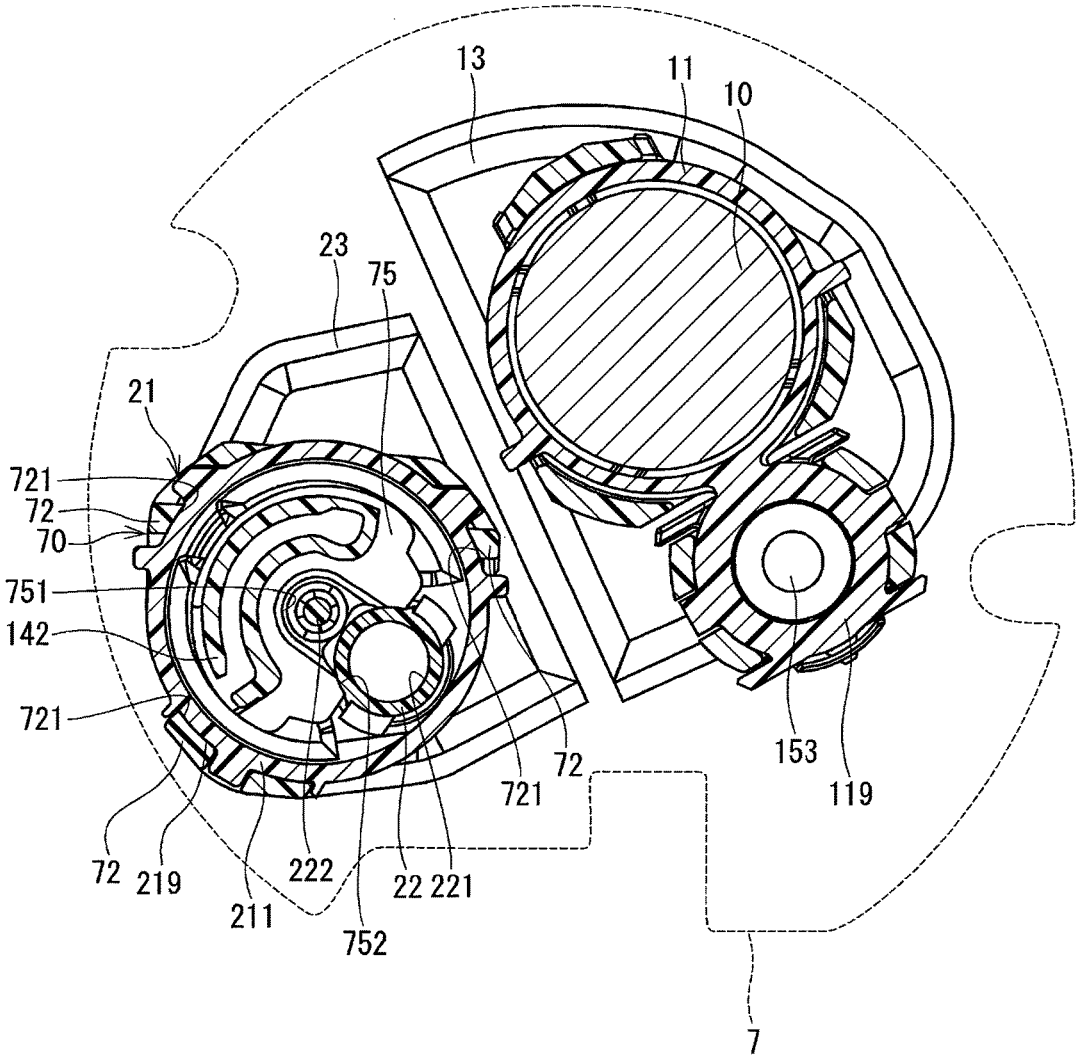
FIG. 5 is a sectional view of the first module along a V-V line in FIG. 4 in one embodiment of the present disclosure.

The elastic member 75 is formed substantially in a C-shape, as shown in FIG. 5. The projected part 222 is positioned in an opening 751 that is formed at the center of the elastic member 75. As such, the elastic member 75 may be positioned concentric to the center axis of the PI fuel pump 20. The suction part 22 that provides the suction port 221 is positioned in a cutout part 752 that communicates with the opening 751. In such manner, when a rotation of the PI fuel pump 20 relative to the pump case 21 about the center axis of the pump case 21 is caused, such a rotation of the PI fuel pump 20 is controlled to be within a certain rotation angle range with respect to the center axis of the pump case 21 due to the abutment of the PI duel pump 20 on the elastic member 75.

Figure 2:
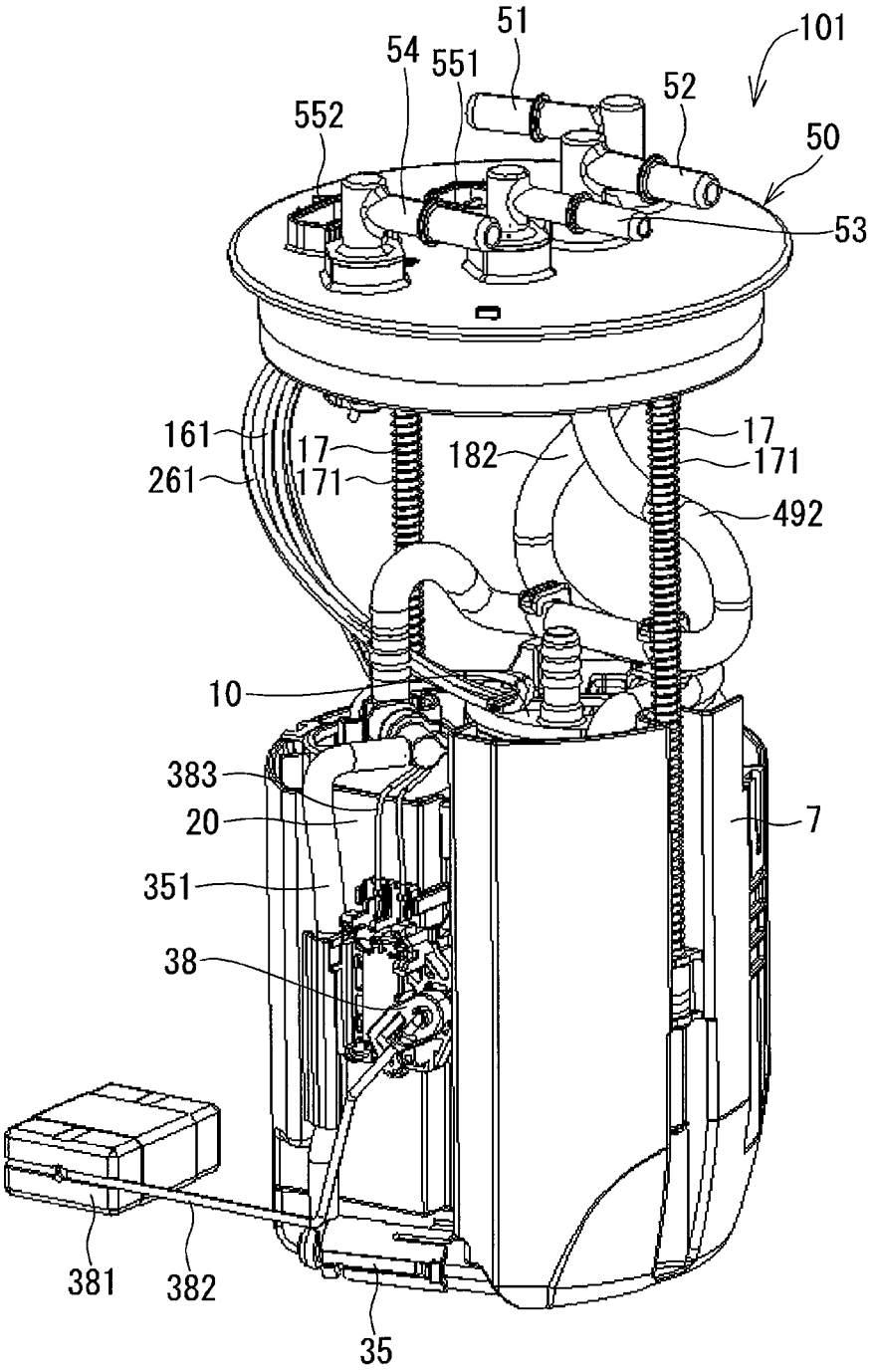
FIG. 2 is a perspective view of a first module in the fuel pump module in one embodiment of the present disclosure.

As shown in FIG. 2, the first jet pump 35 is disposed on the other end of the module 101 relative to the first flange 50, at a radially-outer position of the subtank 7. The first jet pump 35 introduces the fuel from the first tank room 201 to the subtank 7 with a help of the pressure of the discharged fuel from the PI fuel pump 20.

A sender gauge 38 is disposed at a radially-outer portion of the subtank 7, as shown in FIGS. 2 and 3. The sender gauge 38 is connected with a float 381 via an arm 382. When the float 381 moves according to a change of a fuel level, the arm 382 rotates, and the fuel level is detected based on a detection of the rotation amount of the arm 381 by the sender gauge 38. The sender gauge 38 outputs a fuel-level detection signal via a wire harness 383 and the first flange 50 to a non-illustrated electrical control unit (i.e., hereafter an "ECU") which is disposed externally to the module 101.

The first flange 50 is formed in a disk shape, and is positioned on an opening 200 of the first tank 2, which is "one opening" and serves as a cover of the opening 200 (see FIG. 1). A transport port 53 through which the fuel flows from the second tank 3 to the subtank 7 is provided on the first flange 50. A reflux port 54 which allows a reflux of the fuel flowing from a pressure regulating valve 253 disposed in a port injection supply pipe 25 (i.e., hereafter a "PI supply pipe 253") back to the subtank 7 is also provided on the first flange 50. In addition, the DI supply port 51 and the transport port 52 are also provided on the first flange 50. Further, an external connector 551 and an external connector 552 are disposed on the first flange 50. The external connector 551 is electrically connected to the wire harnesses 161 and 261 and supplies an electric power to the DI fuel pump 10 and the PI fuel pump 20. The external connector 552 outputs to an outside of the module 1 a signal of the fuel level which is detected by the sender gauge 38 via the wire harness 383.

The subtank 7 is formed in a bottom-closed cylindrical shape and is made from resin. The subtank 7 houses the DI fuel pump 10, the PI fuel pump 20, and the like, as mentioned above, and, on a radially-outer portion of the subtank 7, the first jet pump 35 and the sender gauge 38 are disposed.

As shown in FIG. 2, the first flange 50 and the subtank 7 are connected by two shafts 17 so that a relative position of the two (i.e., the flange 50 and the subtank 7) is changeable. On a radially-outer portion of the shaft 17, a spring 171 biasing the first flange 50 and the subtank 7 away from each other is disposed. Thereby, the subtank 7 is pressed against a bottom of the first tank 2.

The second module 102 is disposed in the second tank 3. The second module 102 removes foreign substance from the fuel that is sent from the first tank 2 and supplies the fuel to the engine 4, and/or transports the fuel in the second tank 3 to the first tank 2 with a help of the pressure of the fuel that is sent from the first tank 2. The second module 102 is provided with a port injection filter 40 (i.e., hereafter a "PI filter 40"), a filter case 41, a residual pressure maintenance valve 47, a second jet pump 45, a second flange 60, and the like. The PI filter 40 is equivalent to a "second filter" in the claims.

The PI filter 40 is substantially formed in a cylindrical shape, and is housed in the donut shape space in the filter case 41, that has the same shape as the pump case 11 housing the DI fuel pump 10. The PI filter 40 is, for example, made from a conductive resin which does not contain carbon. The PI filter 40 removes foreign substance from the fuel that is sent from the first tank 2.

Figure 8:
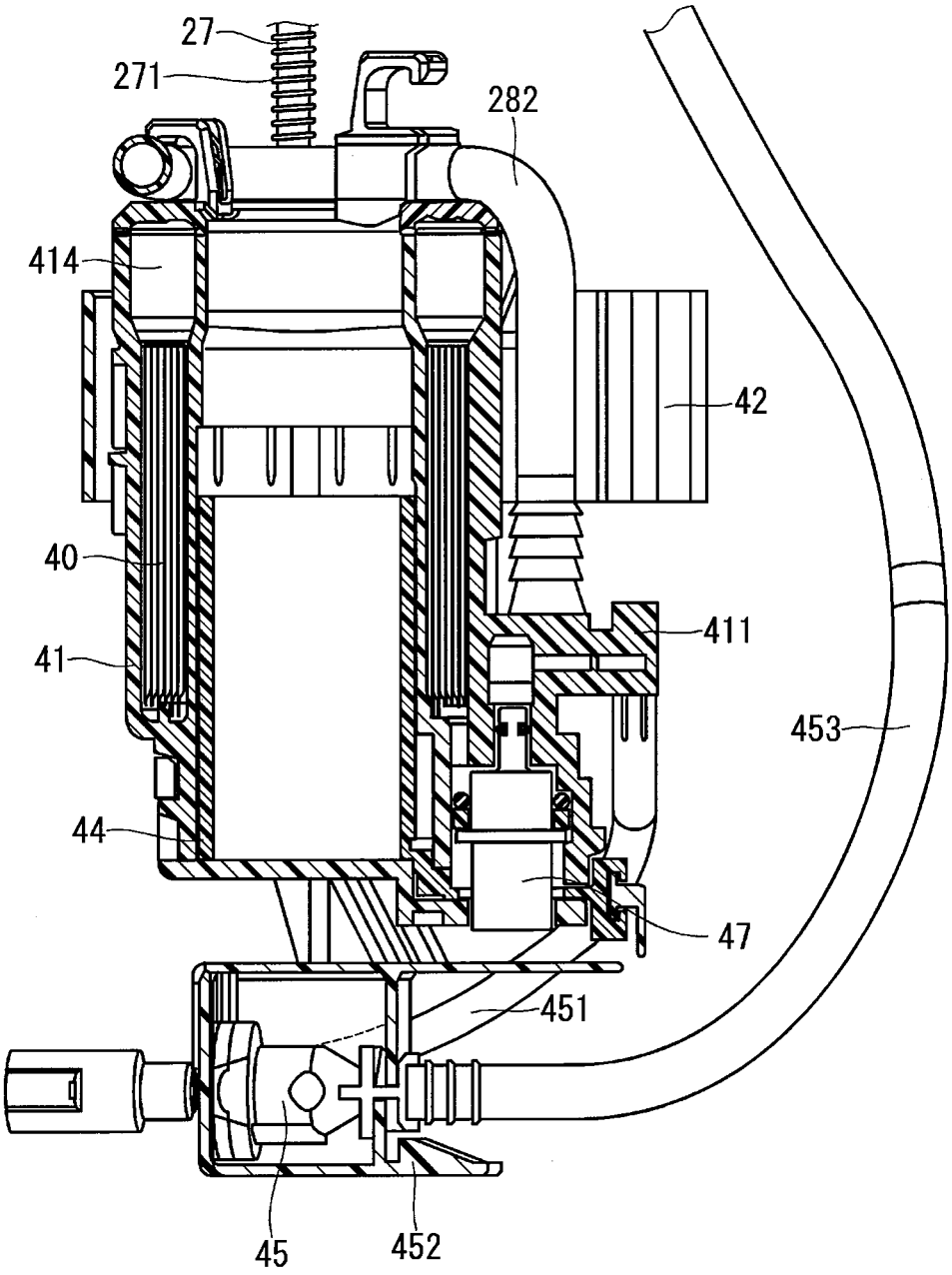
FIG. 8 is a sectional view of the second module in the fuel pump module in one embodiment of the present disclosure.

The filter case 41 is supported by an outer bracket 43 via a ring-shape inner bracket 42 that is substantially in a ring shape. As shown in FIG. 8, a ground bracket 44 grounded to a ground is housed in a cylindrical space that is formed substantially at the center of the filter case 41.

The filter case 41 has, disposed thereon, a transport pipe 412 and a transport port 413, which introduce the fuel from the first tank 2 via a transport port 62 on the second flange 60 into an inside of the case 41. The fuel introduced into the filter case 41 through the transport port 413 passes a fuel passage 414 and the PI filter 40 in an inside of the filter case 41. The fuel passing through the PI filter 40 is supplied to the air-intake system 5 of the engine 4 via a supply pipe 282, a port injection supply port 61 (i.e., hereafter a "PI supply port 61") disposed on the second flange 60, and the PI supply pipe 25 connected to the PI supply port 61. Further, a part of the fuel which passes the PI filter 40 is introduced into the residual pressure maintenance valve 47 that is housed in a radially-outer portion of the filter case 41. The PI supply port 61 is equivalent to a "second supply port" in the claims.

The residual pressure maintenance valve 47 is housed in a connection part 411 disposed on a radially-outer portion of the filter case 41, as shown in FIG. 8. The residual pressure maintenance valve 47 maintains a pressure of the fuel in an inside of the PI filter 40, which is disposed on an upstream side of the valve 47, at a certain level such as 320 kPa, for example, and prevents the fuel in the PI filter 40 from evaporating. The fuel passing through the residual pressure maintenance valve 47 is sent to the second jet pump 45 through a supply pipe 451.

The second jet pump 45 is housed in a subtank 452 that is disposed on an opposite side of the second flange 60 relative to the outer bracket 43 (i.e., an opposite end of the module 102 relative to the second flange 60). The second jet pump 45 is a so-called push-down type jet pump, and suctions the fuel from the second tank 3 with a help of the pressure of the fuel sent from the residual pressure maintenance valve 47. The fuel suctioned by the second jet pump 45 is sent to an outside of the second tank 3 via a transport pipe 453 and a transport port 63 that is disposed on the second flange 60.

Figure 6:
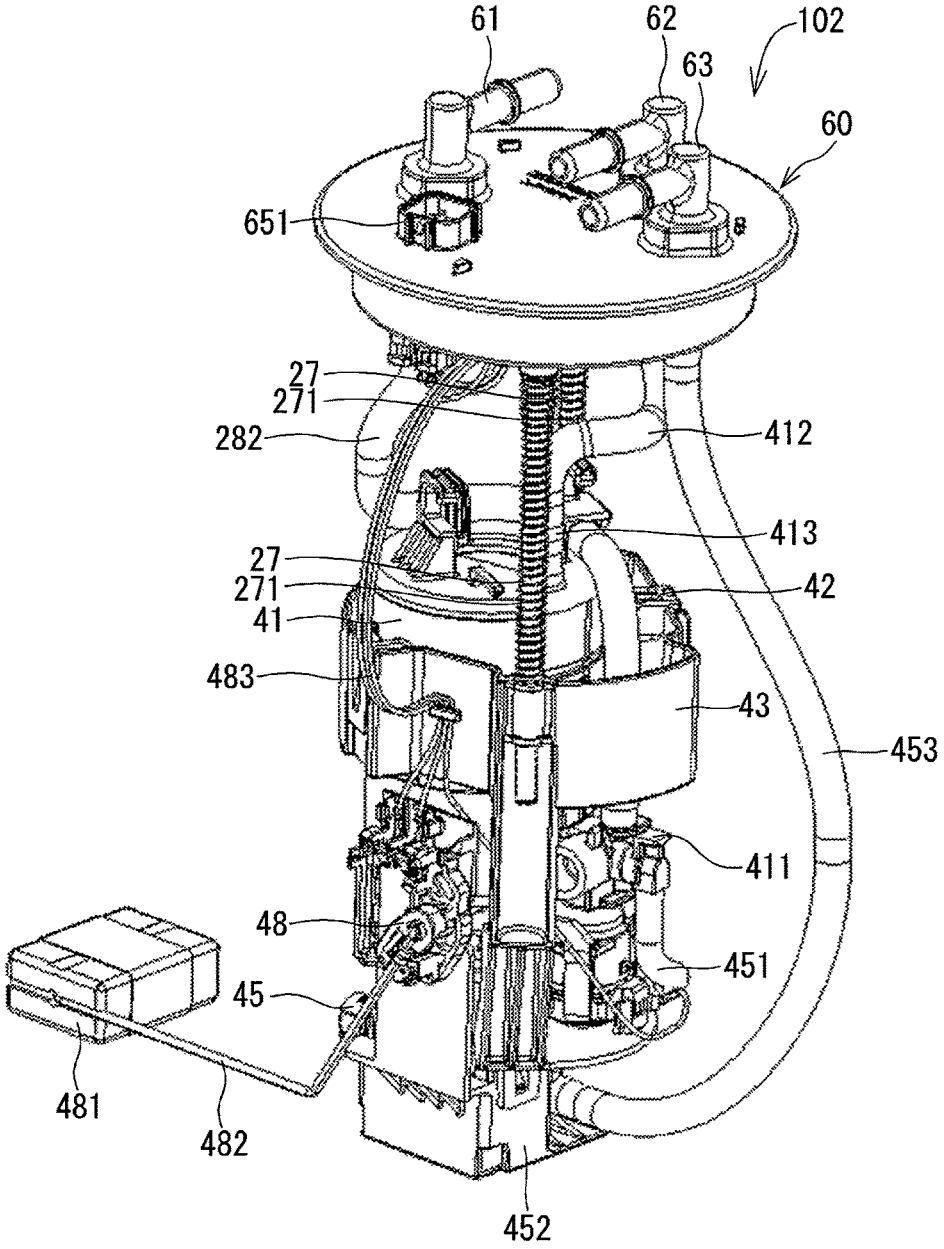
FIG. 6 is a perspective view of a second module in the fuel pump module in one embodiment of the present disclosure.
Figure 7:
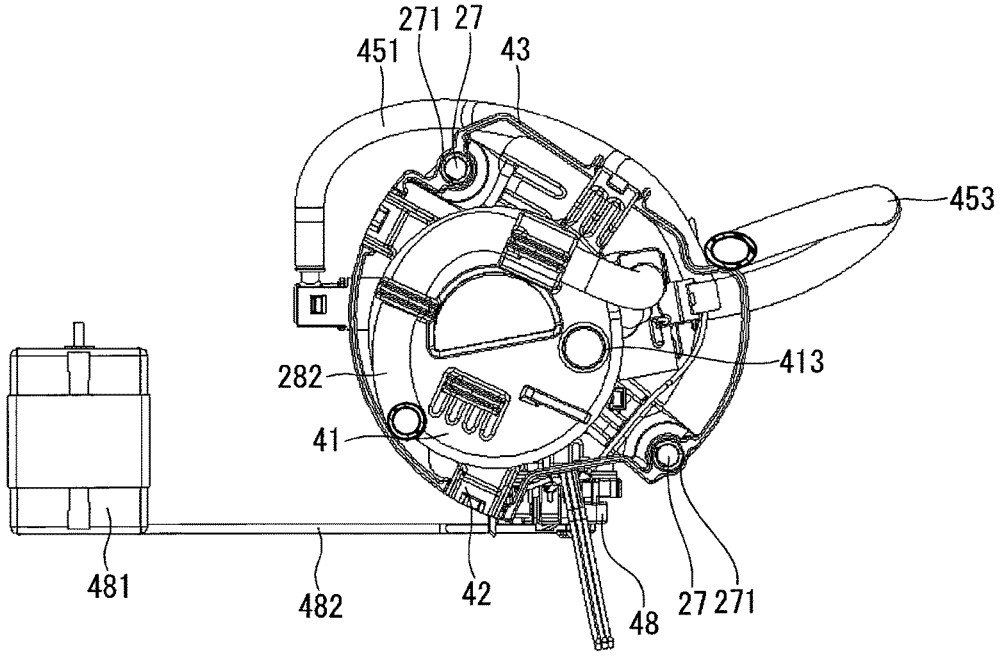
FIG. 7 is a top view of the second module in the fuel pump module in one embodiment of the present disclosure.

A sender gauge 48 is disposed on a radially-outer portion of the filter case 41, as shown in FIG. 6. The sender gauge 48 is connected to a float 481 via an arm 482. When the float 481 moves according to a change of a fuel level, the arm 482 rotates, and a fuel level is detected based on a detection of the rotation amount of the arm 482 by the sender gauge 48. The sender gauge 48 outputs a fuel-level detection signal via the second flange 60 to the ECU that is external to the module 102.

The second flange 60 is formed in a disk shape, and it is put on an opening 300 of the second tank 3, which is an "other opening," and serves as a cover of the opening 300. On the second flange 60, the PI supply port 61 as well as transport ports 62 and 63 are disposed. Further, on the second flange 60, an external connector 651 which outputs a fuel level signal detected by the sender gauge 48 via a wire harness 483 to an outside of the module 102 is disposed.

In the fuel pump module 1, the transport port 52 of the first flange 50 and the transport port 62 of the second flange 60 are connected with each other by the transport pipe 91 through which the fuel flows from the first tank 2 to the second tank 3. Further, the transport port 53 of the first flange 50 and the transport port 63 of the second flange 60 are connected with each other by the transport pipe 92 through which the fuel flows from the second tank 3 to the first tank 2. In such manner, the fuel in the second tank 3 is transported to the first tank 2 in which two fuel pumps are provided, and the fuel in both of the first tank 2 and the second tank 3 is securely supplied to the engine 4.

The second flange 60 and the filter case 41 are connected by two shafts 27 as shown in FIG. 6. On a radially-outer portion of the shaft 27, a spring 271 biasing the second flange 60 and the filter case 41 away from each other is disposed. Thereby, the filter case 41 is pressed against a bottom of the second tank 3 by the spring 271 which biases the case 41 away from the second flange 60.

The operation of the fuel pump module 1 is described in the following.

If an electric power is supplied from outside of the module 1 to the DI fuel pump 10 and the PI fuel pump 20 via the external connector 551, the DI fuel pump 10 and the PI fuel pump 20 are driven, and the fuel in the subtank 7 is suctioned and pressurized via the DI suction filters 13 and 23.

In the DI fuel pump 10, foreign substance is removed from the fuel that is discharged from the pump part 14 by the DI filter 30 that is housed in the pump case 11. After the removal of foreign substance from the fuel by the DI filter 30, the pressure of the fuel is adjusted to a suitable value by the pressure regulating valve 153, and the fuel having a suitable pressure is directly supplied to the combustion chamber 6 of the engine 4 through the supply pipe 182, the DI supply port 51 on the first flange 50 and the supply pipe 15.

On the other hand, in the PI fuel pump 20, the fuel discharged from the pump part 24 is in part transported into the second tank 3 through the transport pipe 492, the transport port 52 on the first flange 50, the transport pipe 91, the transport port 62 on the second flange 60, and the transport pipe 412, after passing through the non-return valve 49. Further, the fuel discharged from the pump part 24 is in part supplied to the first jet pump 35 through the supply pipe 351. The first jet pump 35 introduces the fuel from the first tank 2 into the subtank 7 with a help of the pressure of the supplied fuel.

Foreign substance is removed from the pressurized fuel, which is transported from the first tank 2 to the second tank 3 through the transport pipe 91, by the PI filter 40. The fuel passing through the PI filter 40 is in part supplied to the air-intake system 5 of the engine 4 through a supply pipe 282, the PI supply port 61 on the second flange 60, and the PI supply pipe 25. At this time, the pressure of the supplied fuel passing through the PI supply pipe 25 is adjusted by the pressure regulating valve 253 according to the pressure of a suction air introduced via a vent pipe 255 which is in communication with the air-intake system 5, for example. The fuel not going to be supplied to the air-intake system 5 due to the pressure adjustment returns to an inside of the first tank 2 via a return pipe 254 and the reflux port 54 on the first flange 50.

Further, the fuel passing through the PI filter 40 is in part supplied to the second jet pump 45 through the residual pressure maintenance valve 47 and the supply pipe 451. The second jet pump 45 sends the fuel from the second tank 3 to the subtank 7 via the transport pipe 453, the transport port 63 on the second flange 60, the transport pipe 92, and the transport port 53 on the first flange 50 with a help of the pressure of the supplied fuel. Thereby, the fuel of the second tank room 301 is pressurized by the DI fuel pump 10 and the PI fuel pump 20 in the first tank 2, and is supplied to the engine 4.

In the fuel pump module 1 of one embodiment, the DI fuel pump 10 is housed in the pump case 11 that is supported by the pump case 21. Thereby, vibration generated by the drive operation of the DI fuel pump 10 is transmitted to the subtank 7 and to the fuel tank 8 via the pump case 11 and the pump case 21. On the other hand, the PI fuel pump 20 is housed in the pump case 21 that is directly supported by the subtank 7. Thereby, vibration generated by the drive operation of the PI fuel pump 20 is transmitted to the subtank 7 and to the fuel tank 8 via the pump case 21. Therefore, vibration of the PI fuel pump 20 is transmitted to the subtank 7 relatively easily. Thus, the bracket 70 and the elastic member 75 are provided in the fuel pump module 1. That is, the bracket 70 is provided to engage with the pump case 21, and the elastic member 75 is provided to abut the bracket 70 at a position between the PI fuel pump 20 and the bracket 70. The bracket 70 and the elastic member 75 make it difficult for the vibration to be transmitted from the PI fuel pump 20 to the pump case 21. In such manner, the vibration transmitted to the subtank 7 and the fuel tank 8 is reduced, thereby reducing the noise generated by such reduced vibration of the fuel tank 8.

(Other Embodiments)

(a) In the above-mentioned embodiment, the fuel tank is a divided-tank type, in which two tanks, primary and secondary, are in communication through a transport pipe. However, the fuel tank may be other types, such as a saddle-shape tank in which a bottom of the fuel tank is divided into two bottom parts, making each of the two parts respectively serving as a "fuel reservoir room." Further, the number of "fuel reservoir rooms" is not necessarily limited to two, but may be three or more. When there is only one fuel reservoir room, two pumps and two filters may be housed in one subtank.

(b) In the above-mentioned embodiment, it is described that the support part of the pump case in which the PI fuel pump is housed supports the pump case in which the DI fuel pump supplying fuel to the combustion chamber and the filter for DI are housed. However, a relationship between the supporting pump case and the supported pump case may be provided in a manner alternative to the above. The pump case in which one of the DI fuel pump or the PI fuel pump is housed may support the pump case in which the other one of the DI fuel pump or the PI fuel pump is housed.

(c) In the above-mentioned embodiment, the support part of the pump case in which the PI fuel pump is housed has the stay that is connected to the subtank. However, the support part may be connected to the subtank by a member other than a stay.

As mentioned above, the present disclosure is not necessarily limited to the above-described embodiments, but may have other variations, as long as the variations are within the gist of the above-described idea of the fuel pump module.

What is claimed is:

1. A fuel pump module configured to supply fuel from a fuel tank to an internal-combustion engine, the fuel pump module comprising:

a first suction filter configured to remove foreign substance from fuel in the fuel tank;

a first pump configured to discharge fuel that has passed through the first suction filter into a combustion chamber of the internal-combustion engine;

a first filter configured to remove foreign substance from fuel that is discharged from the first pump;

a first supply port disposed at a position configured to be between the first filter and the combustion chamber and configured to allow fuel that has passed through the first filter to flow therethrough;

a second suction filter configured to remove foreign substance from fuel in the fuel tank separately from the first suction filter;

a second pump configured to discharge fuel that has passed through the second suction filter into an air-intake system of the internal-combustion engine;

a second filter configured to remove foreign substance from fuel that is discharged from the second pump;

a second supply port disposed at a position configured to be between the second filter and the air-intake system and configured to allow fuel that has passed through the second filter to flow therethrough;

a housing that houses one of the first pump and the second pump;

a support part formed on the housing and supporting an other of the first pump and the second pump;

a bracket engaged with the housing at a position between (i) the first suction filter and the first pump or (ii) the second suction filter and the second pump, the bracket being configured to regulate a relative movement of the first pump or the second pump toward a center axis thereof relative to the housing; and an elastic member made of an elastic material, that abuts the bracket, and interposed between (i) the first pump and the bracket or (ii) the second pump and the bracket.

2. The fuel pump module according to claim 1, wherein the elastic member is formed in a C-shape.

3. The fuel pump module according to claim 1, wherein the elastic member is positioned concentric with the center axis of the first pump or the second pump.

4. The fuel pump module according to claim 1, wherein the elastic member has an opening at a center thereof, and a projected part of the first pump or the second pump is positioned in the opening.

5. The fuel pump module according to claim 1, wherein the elastic member has a cutout part, and a suction port of the first pump or the second pump is positioned in the cutout part.

6. The fuel pump module according to claim 1, wherein the elastic member abuts the second pump.

7. The fuel pump module according to claim 1, wherein the elastic member abuts the bracket inside the housing between (i) the first pump and the bracket or (ii) the second pump and the bracket.

8. The fuel pump module according to claim 1, wherein the elastic member abuts a base part of the bracket and a guide part on a connection part of the second suction filter.

9. The fuel pump module according to claim 1, wherein (i) a rotation of the first pump relative to the housing about the center axis of the housing is controlled to be within a predetermined rotation angle range with respect to the center axis of the housing due to abutment of the first pump on the elastic member, or (ii) a rotation of the second pump relative to the housing about the center axis of the housing is controlled to be within the predetermined rotation angle range with respect to the center axis of the housing due to abutment of the second pump on the elastic member.

10. The fuel pump module according to claim 1, wherein the elastic member is configured to reduce transmission of vibration from the first pump or the second pump to the bracket, thereby reducing the transmission of the vibration to the housing.

* * * * *